US008435162B1

(12) United States Patent
Al-Oboudi

(10) Patent No.: US 8,435,162 B1
(45) Date of Patent: May 7, 2013

(54) WEIGHT ASSIST LIMB ENERGIZER AND EXERCISE DEVICE

(76) Inventor: Waleed Al-Oboudi, La Jolla, CA (US)

( * ) Notice: Subject to any disclaimer, the term of this patent is extended or adjusted under 35 U.S.C. 154(b) by 0 days.

(21) Appl. No.: 12/192,916

(22) Filed: Aug. 15, 2008

Related U.S. Application Data

(60) Provisional application No. 60/956,091, filed on Aug. 15, 2007.

(51) Int. Cl.
*A63B 21/06* (2006.01)
*A63B 21/00* (2006.01)

(52) U.S. Cl.
USPC ..... 482/97; 482/92; 482/93

(58) Field of Classification Search ..... 482/91–94, 482/97–103, 131–137; 472/111, 112, 115; 473/56, 162, 171, 422, 433; 273/110
See application file for complete search history.

(56) References Cited

U.S. PATENT DOCUMENTS

| | | | | | |
|---|---|---|---|---|---|
| 2,159,122 | A * | 5/1939 | Armstrong | 473/132 |
| 2,955,823 | A * | 10/1960 | Chanko | 124/7 |
| 4,274,627 | A * | 6/1981 | Fenner et al. | 482/97 |
| 4,676,504 | A * | 6/1987 | Ponza | 124/7 |
| 4,955,606 | A * | 9/1990 | Leps | 124/50 |
| 5,042,802 | A * | 8/1991 | Depianta | 124/50 |
| 5,097,985 | A * | 3/1992 | Jones | 221/86 |
| 5,232,218 | A * | 8/1993 | Leps | 124/50 |
| D348,709 | S * | 7/1994 | Leps | D21/720 |
| 5,421,313 | A * | 6/1995 | Strayer | 124/1 |
| 5,673,918 | A * | 10/1997 | Bigari | 273/395 |
| 5,951,406 | A * | 9/1999 | Steane | 472/111 |
| 6,435,990 | B1 * | 8/2002 | Bradley | 473/453 |
| 6,461,255 | B1 * | 10/2002 | Smith | 473/417 |
| 6,575,119 | B1 * | 6/2003 | Lonsway | 119/708 |
| 6,616,555 | B2 * | 9/2003 | Bewley | 473/451 |
| 6,949,034 | B2 * | 9/2005 | Vitello et al. | 473/433 |
| 6,974,396 | B2 * | 12/2005 | Mauer et al. | 473/417 |
| 7,214,147 | B2 * | 5/2007 | Gutierrez | 473/417 |
| 7,258,633 | B2 * | 8/2007 | Joseph et al. | 473/433 |
| 7,465,243 | B2 * | 12/2008 | Cramer | 473/417 |
| 7,819,763 | B2 * | 10/2010 | Campbell et al. | 473/453 |
| 2009/0227401 | A1 * | 9/2009 | Mauer et al. | 473/451 |

* cited by examiner

*Primary Examiner* — Loan Thanh
*Assistant Examiner* — Sandhara Ganesan
(74) *Attorney, Agent, or Firm* — Knobbe Martens Olson & Bear, LLP

(57) ABSTRACT

A device for encouraging and exercising limb movement of patients who have been affected by a stroke, brain injury, or other orthopedic conditions is provided. The device is preferably designed to encourage the slightest movement present in the limbs so that the limbs are initially encouraged and practiced. Preferably, the device is designed to displace the weight of the limb (upper extremity or lower extremity) allowing the patient the opportunity to practice using the slightest amount of available active range of motion (ROM). In one implementation, the device includes a teeter-totter balancing beam, a shaft and a base. The balancing beam is pivotably connected to the shaft via joint member and is designed to pivot laterally about the joint member.

2 Claims, 4 Drawing Sheets

WEIGHT ASSIST LIMB ENERGIZER AND EXERCISE DEVICE

CROSS-REFERENCE TO RELATED APPLICATIONS

This application claims the benefit of priority under 35 U.S.C. §119(e) of U.S. Provisional Application No. 60/956,091 filed on Aug. 15, 2007, which is incorporated herein by reference in its entirety.

BACKGROUND OF THE INVENTION

1. Field of the Invention

The present invention generally relates to therapeutic devices and, in particular, relates to a therapeutic device for use in rehabilitating limbs of patients affected by a stroke, brain injury, or other orthopedic conditions.

2. Description of the Related Art

Individuals with neurological impairments such as that resulting from a stroke or injury often suffer from muscle spasticity and weakness of muscle, which are usually caused by damage to the systems that control voluntary muscle movements. In weakness of muscle, the systems which control motor function are damaged, resulting in paralysis and degeneration of muscle. As a consequence, the individual often loses the ability to move the limbs. Physical therapy is usually used to restore the individual's limb movement and other motor skills. To this end, there is a need for an improved therapeutic device to restore limb function of patients.

SUMMARY OF THE INVENTION

The systems, methods, and devices of the invention each have several aspects, no single one of which is solely responsible for its desirable attributes. Without limiting the scope of this invention, its more prominent features will now be discussed briefly.

In one aspect, the preferred embodiments of the present invention provide a device for encouraging and exercising limb movement of patients who have been affected by a stroke, brain injury, or other orthopedic conditions. The device is preferably designed to encourage the slightest movement present in the limbs so that the limbs are initially encouraged and practiced. Preferably, the device is designed to displace the weight of the limb (upper extremity or lower extremity) allowing the patient the opportunity to practice using the slightest amount of available active range of motion (ROM). In one embodiment, the device comprises a teeter-totter balancing beam, a shaft and a base. The balancing beam is pivotably connected to the shaft via joint member and is designed to pivot laterally about the joint member. In a preferred implementation, an adjustable weight is attached to one end of the balancing beam and a handle is attached to the other end. The amount of adjustable weight provides an objective measure as to the amount of assistance patients are required to reach or move their limbs. The amount of assistance provided can be graded as the patient improves. In some implementations, a special see-through track is built on the bed of the balancing beam. In one implementation, a ball is placed in the track to roll back and forth as the patient moves his limb(s). This allows for feedback to encourage the patient to move at desired, or specific set points.

In a preferred implementation, the entire device is designed to be adjustable and mobile to adapt to many conditions of observation required for therapeutic practice and various environments in rehabilitation of the upper and lower extremities. The shaft supporting the teeter-totter balancing beam is adjustable in height and also allows for side to side or lateral movements, as well as movements in a variety of angles. The teeter-totter balancing beam is preferably made of light-weight and yet durable aluminum that can be easily broken down in half or assembled into one piece for easy mobility or storage. In one embodiment, the base is made of steel and designed to expand the durability use or retract for easy mobility and storage. The base is designed to have the option of wheels to roll the entire unit or to have a standard padded handle for easy and comfortable carrying.

Advantageously, the device is designed to encourage even the slightest movement present in the limbs. Moreover, the adjustable weight provides an objective measure to the patient's progress and visual feedbacks to further encourage the patient.

DETAILED DESCRIPTION OF THE PREFERRED EMBODIMENT

The preferred embodiments of the present invention provide a weight assist limb energizer and exercise device (WALEED) adapted to facilitate and encourage movements present in the limb(s) of patients who suffer from stroke, brain injury or other orthopedic conditions.

Figure 1:
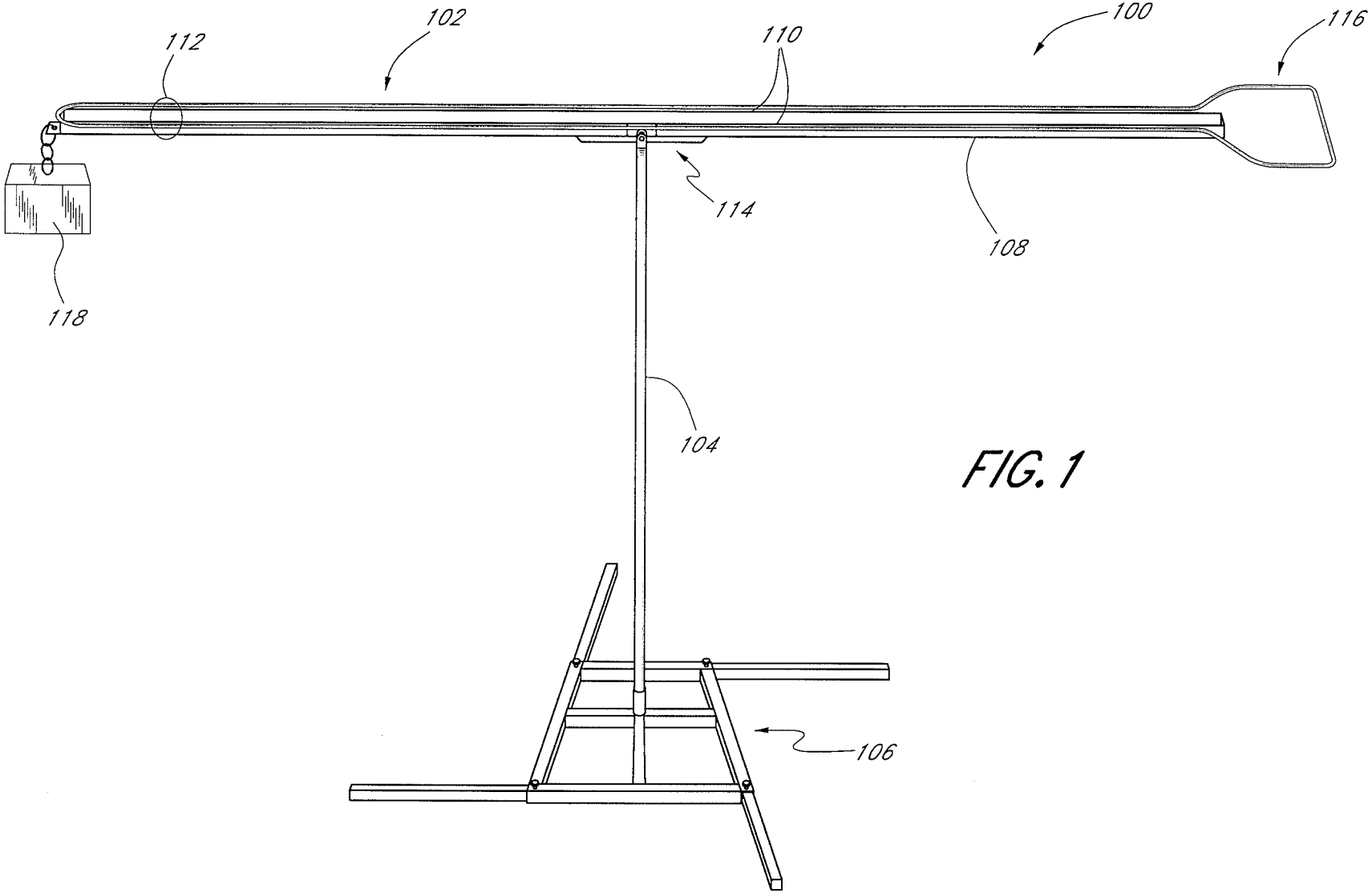
FIG. 1 is a schematic illustration of a weight assist limb energizer and exercise device of one embodiment of the present invention.

FIG. 1 is a schematic illustration of a device 100 of one preferred embodiment of the present invention. The device 100 generally comprises a horizontal, teeter-totter balancing beam 102, a vertical shaft 104 pivotably attached to the beam 102, and a base structure 106. In one implementation, the balancing beam 102 comprises a plurality of railings 108 defining an elongated track 110 adapted to receive a ball 112. The balancing beam 102 can be pivoted about a joint 114 interconnecting the balancing beam and the shaft. As the balancing beam is pivoted, the ball 112 will roll along the track. The rolling ball 112 advantageously serves as a visual feedback of the patient's efforts in moving his limb(s) and such visualization provides further encouragement. As FIG. 1 further shows, the device 100 also includes a gripping member or handle 116 disposed on one end of the balance beam 102 and adjustable weights 118 disposed on the other end. In one embodiment, the entire device can be easily disassembly and stored in a compact manner.

Figure 2:
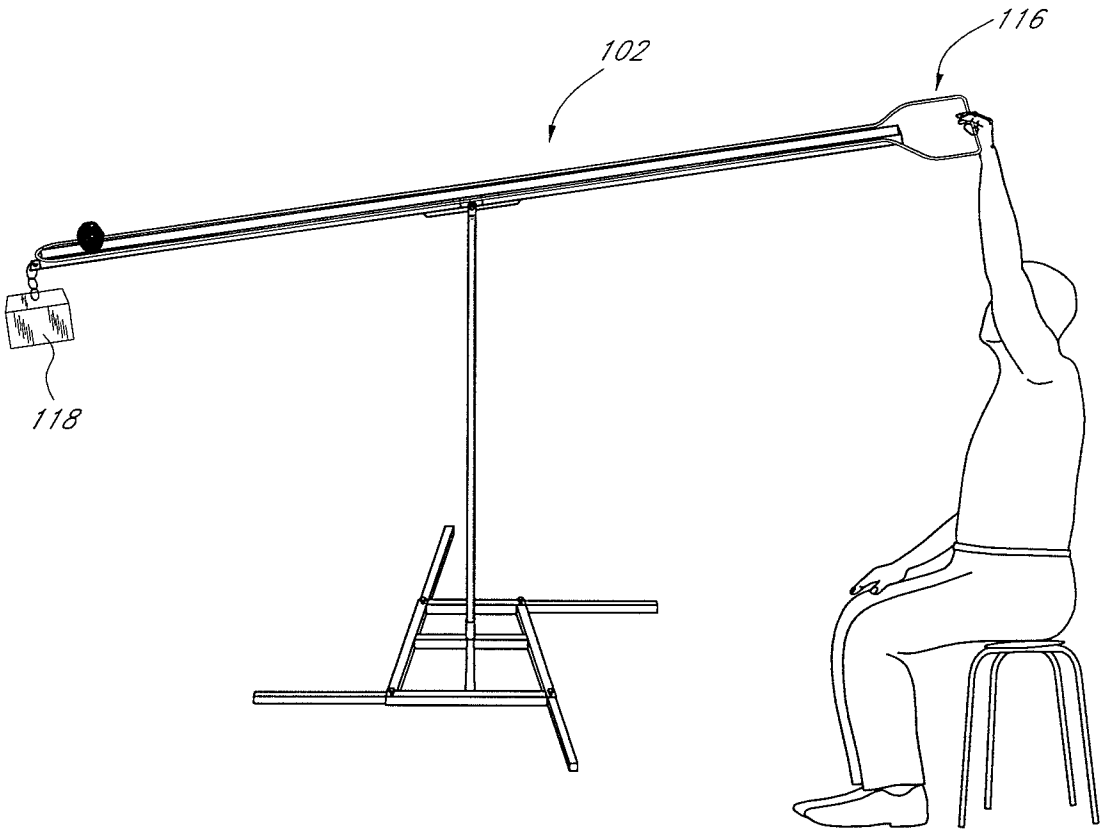
FIG. 2 illustrates the manner in which the device of FIG. 1 can be used to exercise a patient's limb(s)
Figure 3:
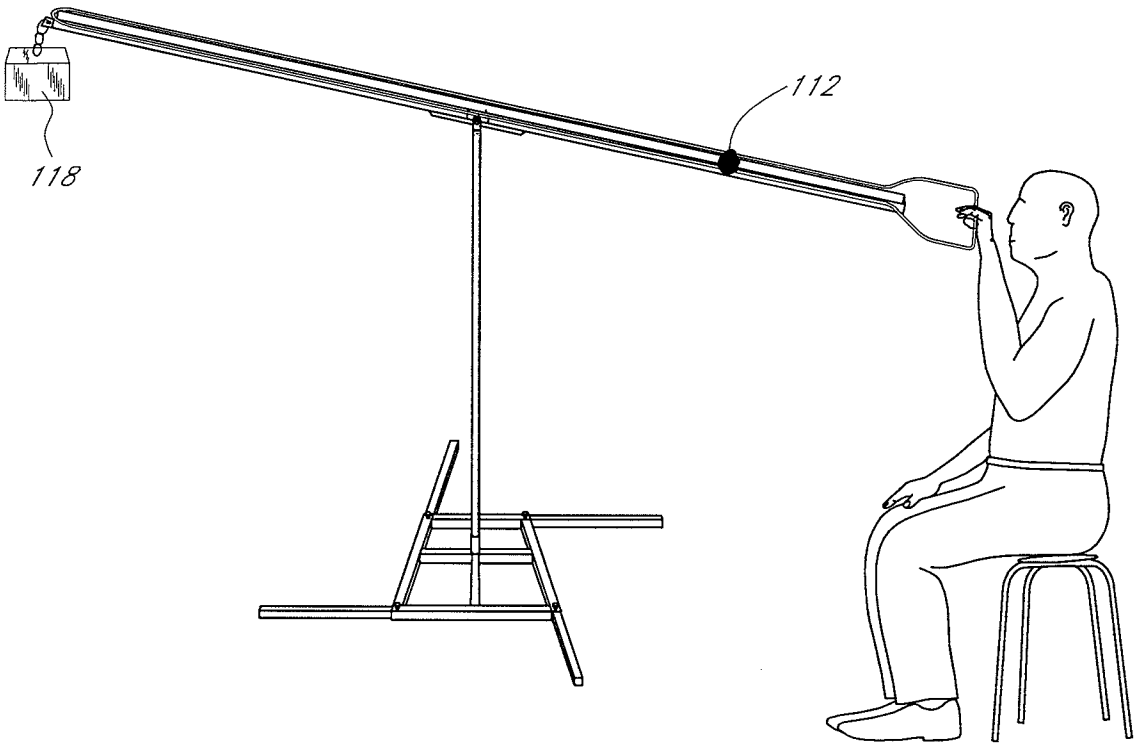
FIG. 3 illustrates the manner in which the device of FIG. 1 can be used to exercise a patient's limb(s)

FIG. 2 illustrates the manner in which a patient is initially assisted to reach and grasp the handle 116. At this point, the balancing beam is pivoted toward the end attached to the adjustable weights. As shown in FIG. 3, as the patient uses his limb to move the balancing beam, the beam is pivoted toward the patient and the ball 112 will roll toward the patient. The repetitive movement of the patient pivoting the balancing beam about the joint allows the patient to exercise the limb(s) and restore their ROM.

Figure 4:
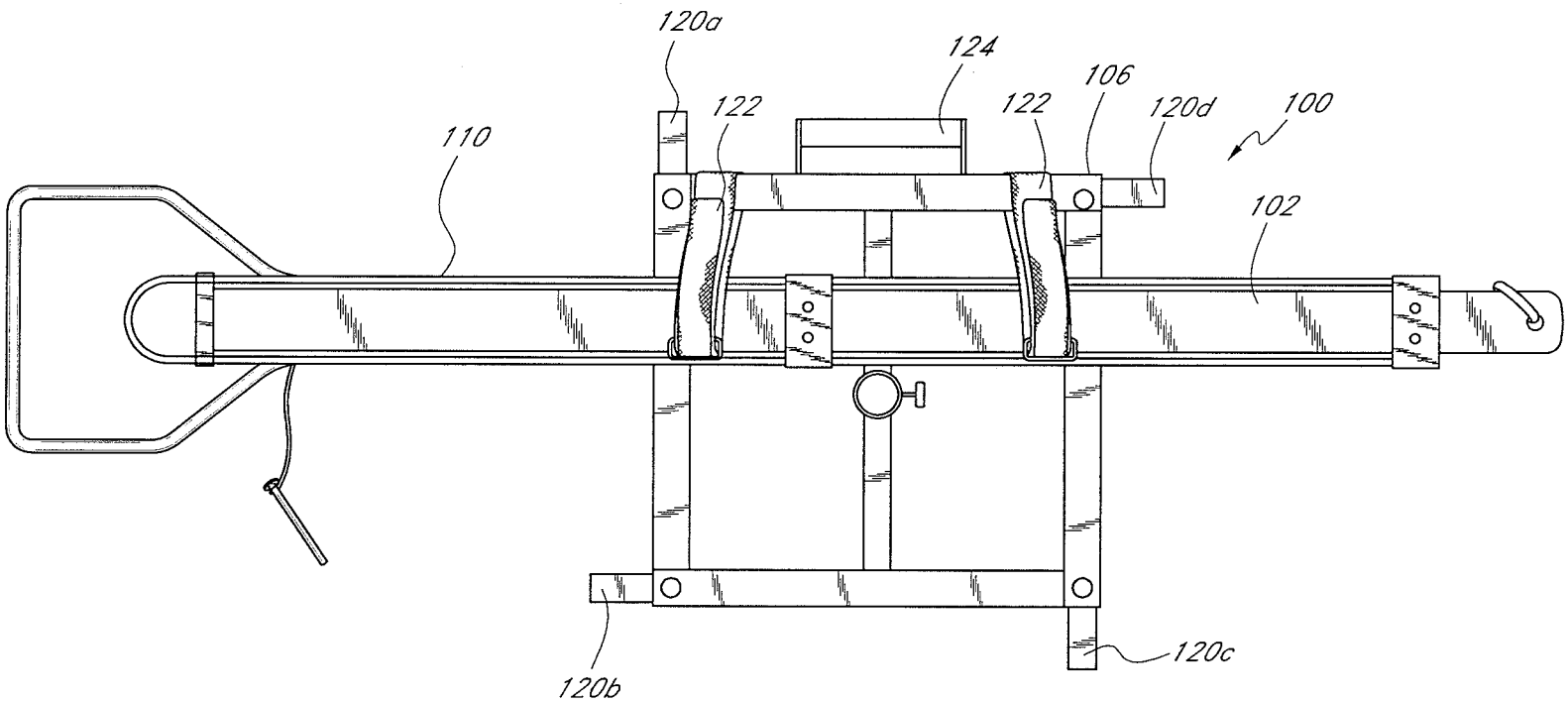
FIG. 4 illustrates the manner in which the device can be retracted into a compact configuration fit for transporting.

FIG. 4 illustrates the device 100 in a retracted configuration. As shown in FIG. 4, in a retracted configuration, the balance beam 102 is folded and the vertical shaft 104 is collapsed in a manner such that the folded balance beam 110 is positioned adjacent the base structure 106. The legs 120*a-d* of the base structure 106 are retracted telescopically to further reduce the size of the device 100. In one embodiment, straps 122 can be used to secure the folded balance beam 102 to the base structure 106. In another embodiment, the device 100 further includes a handle 124 adapted for a person to carry the device 100 like a suitcase. As illustrated in FIG. 4, the device 100 in a retracted configuration is compact and can be easily carried.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separated from others.

What is claimed is:

1. A therapeutic device for rehabilitating limbs of patients with neurological disorders, comprising:

a vertical shaft having an upper end and a lower end;

a joint member;

a horizontal beam, said beam having a track adapted to receive a ball, wherein the horizontal beam is pivotably attached to the upper end of the vertical shaft via the joint member such that the beam is adjustable in height and such that the beam can move at a variety of angles;

a base structure adapted to be removably attached to the lower end of the vertical shaft;

adjustable weights disposed on one end of the horizontal beam to provide resistance when the patient exerts force on the device, said weights hang from the end of the horizontal beam in a position such that the entire weight can rest below the beam, wherein the amount of adjustable weight provides an objective measure as to the amount of assistance patients need from another person to move their limbs;

an adapted handle, said handle is attached to the other end of the horizontal beam, said handle is adapted for a person to grasp so as to pivot the horizontal beam by exerting force on the handle;

a ball, which rolls down the track toward or away from the person when force is exerted on the handle, wherein rolling of the ball serves as a visual feedback for the person's efforts or as a measurement for the patient's movement at desired set points when pivoting the horizontal beam; and wherein the joint member pivotably connects the horizontal beam with the base structure in a manner such that the horizontal beam is pivoted about the base structure when the patients exerts a force on the handle attached to the other end of the horizontal beam.

2. The device of claim 1, wherein the device can be retracted in a compact configuration for storage and transport.

* * * * *